US007003973B2

(12) United States Patent
Lee et al.

(10) Patent No.: US 7,003,973 B2
(45) Date of Patent: Feb. 28, 2006

(54) REFRIGERATOR AND COOLING SYSTEM THEREFOR

(75) Inventors: Jong Dal Lee, Suwon (KR); Gi Joong Jeong, Kwangiu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 66 days.

(21) Appl. No.: 10/673,184

(22) Filed: Sep. 30, 2003

(65) Prior Publication Data

US 2004/0139759 A1 Jul. 22, 2004

(30) Foreign Application Priority Data

Jan. 17, 2003 (KR) ..... 10-2003-0003375

(51) Int. Cl.
*F25D 19/00* (2006.01)

(52) U.S. Cl. ..... 62/298; 62/440

(58) Field of Classification Search ..... 62/298, 62/440, 457.1, 371, 458
See application file for complete search history.

(56) References Cited

U.S. PATENT DOCUMENTS

| | | | | |
|---|---|---|---|---|
| 5,231,849 | A * | 8/1993 | Rosenblatt | 62/238.3 |
| 6,253,668 | B1 * | 7/2001 | Lee | 99/468 |
| 2002/0002838 | A1 * | 1/2002 | Kim | 62/440 |
| 2002/0029579 | A1 * | 3/2002 | Sohn et al. | 62/285 |

FOREIGN PATENT DOCUMENTS

JP 2000205595 A * 1/1999

OTHER PUBLICATIONS

Korean Patent Abstract Publication No. 2001-27964, Publication Date Apr. 6, 2001.

* cited by examiner

*Primary Examiner*—Melvin Jones
(74) *Attorney, Agent, or Firm*—Staas & Halsey LLP

(57) ABSTRACT

A refrigerator, including a cabinet having an inner casing to define an inner surface of the refrigerator and an outer casing to define an outer surface of the refrigerator, a machine room defined by the outer casing so as to be provided outside the outer casing, a cooling compartment defined by the inner casing, a compressor installed at a predetermined position of the machine room, a cooling set installed at a predetermined position of the cooling compartment, having an evaporator, and a flexible refrigerant pipe connecting the compressor to the evaporator.

37 Claims, 3 Drawing Sheets

REFRIGERATOR AND COOLING SYSTEM THEREFOR

CROSS-REFERENCE TO RELATED APPLICATIONS

This application claims the benefit of Korean Application No. 2003-3375, filed Jan. 17, 2003, in the Korean Intellectual Property Office, the disclosure of which is incorporated herein by reference.

BACKGROUND OF THE INVENTION

1. Field of the Invention

The present invention relates, in general, to a refrigerator and a cooling system. More particularly, the present invention relates to a refrigerant pipe which connects an evaporator to a compressor of the cooling system.

2. Description of the Related Art

As is well known to those skilled in the art, a cooling system circulates a refrigerant in an air conditioner or a refrigerator, and air is cooled by the refrigerant circulation cycle. The cooling system includes a refrigerant circulation unit and peripheral units.

The refrigerant circulation unit includes a compressor, a condenser, a pressure reducing unit, an evaporator, and a refrigerant pipe. In this case, the compressor functions to compress a refrigerant. The condenser condenses the compressed refrigerant, which is fed from the compressor. The pressure reducing unit reduces pressure of the condensed refrigerant after it leaves the condenser. The evaporator then evaporates the pressure-reduced refrigerant fed from the pressure reducing unit, thus absorbing heat from air in a space around the evaporator, which cools the air in that space. The refrigerant pipe connects the above-mentioned components to each other, thus providing a refrigerant path. In this case, the condenser and the evaporator serve as a heat exchanger. The refrigerant pipe comprises a copper pipe which has excellent corrosion-resistance and workability.

The cooling system also has peripheral units, including a condenser-side motored fan, an evaporator-side motored fan, and others. The condenser-side fan circulates air around the condenser to perform a heat exchange process. The evaporator-side fan circulates air around the evaporator to perform a heat exchange process. The condenser-side fan motor and the evaporator-side fan motor drive the condenser-side fan and the evaporator-side fan, respectively. The evaporator and the evaporator-side motored fan function to cool air around the evaporator, and they are hereinafter collectively referred to as a cooling set.

However, when a peripheral unit, such as a fan and/or a fan motor, breaks down, one or more of the components constituting the refrigerant circulation unit must be moved so as to replace or repair the malfunctioning peripheral unit. For example, when the motor for rotating the fan to circulate air in the evaporator malfunctions, it is necessary to move the evaporator by a predetermined distance so as to replace or repair the motor. In this case, after removing the evaporator from the refrigerant circulation unit in order to service the motor, the refrigerant is wholly removed from the refrigerant circulation unit. Then, the refrigerant is refilled into the refrigerant circulation unit after the assembly is completed, thus making the repair work complicated to perform, and causing a waste of the refrigerant. Therefore, it is desirable that, instead of removing the evaporator from the circulation unit, the evaporator is only moved by a predetermined distance without moving other components of the refrigerant circulation unit. However, such a method is problematic in that the greatest care of an operator is required, and the refrigerant pipe comprising a copper pipe may be bent or broken due to carelessness, in which case more involved maintenance may be required. Particularly, when the evaporator and the evaporator-side motored fan are assembled into a cooling set of a single structure and it is necessary to move the evaporator to replace or repair the peripheral unit, the above-mentioned problems occur more frequently.

SUMMARY OF THE INVENTION

Accordingly, it is an aspect of the present invention to provide a refrigerant pipe which connects an evaporator to a compressor and is designed to be flexible and have a force of restoration, thus preventing the refrigerant pipe from being damaged even when the refrigerant pipe is bent.

Additional aspects and advantages of the invention will be set forth in part in the description which follows and, in part, will be obvious from the description, or may be learned by practice of the invention.

The foregoing and/or other aspects of the present invention are achieved by providing a refrigerator, including a cabinet, a machine room, a cooling compartment, a compressor, a cooling set, and a flexible refrigerant pipe. The cabinet has an inner casing to define an inner surface of the refrigerator and an outer casing to define an outer surface of the refrigerator. The machine room is defined by the outer casing in such a way as to be provided outside the outer casing. The cooling compartment is defined by the inner casing. The compressor is installed at a predetermined position of the machine room. The cooling set is installed at a predetermined position of the cooling compartment, and has an evaporator. The flexible refrigerant pipe connects the compressor to the evaporator.

Also, the refrigerant pipe may be able to resume a former shape.

Also, the cooling set may include a fan and a fan motor, and elements of the cooling set may be assembled into a single structure.

Also, upper surfaces of the inner and outer casings may have a same stepped structure, and the machine room is provided in a space which is defined above a lower portion of the stepped structure of the outer casing, and the cooling set is provided in a space which is defined under an upper portion of the stepped structure of the inner casing. The cooling set also includes an evaporator fan and an evaporator fan motor. In this case, the evaporator fan and fan motor are provided above the evaporator, and the elements of the cooling set are assembled into a single structure. The cooling set also includes a cover to cover a bottom of the evaporator, and the elements of the cooling set are assembled into a single structure. The cover also has circulation holes to circulate cool air. The stepped structure is designed such that its lower portion is defined at a front portion of the refrigerator, and its upper portion is defined at a rear portion of the refrigerator.

Also, the cooling compartment may include a pipe cover to cover the refrigerant pipe. The pipe cover may have circulation holes to circulate cool air.

Also, the refrigerant pipe may have a bellows pipe structure.

The foregoing and other/or aspects of the present invention are also achieved by providing a refrigerator, including a cabinet, a machine room defined outside the cabinet, a cooling compartment defined in the cabinet, a compressor installed at a predetermined position of the machine room, an evaporator installed at a predetermined position of the cooling compartment, an evaporator's peripheral unit including an evaporator fan and an evaporator fan motor, and a flexible refrigerant pipe connecting the compressor to the evaporator.

Further, the foregoing and/or other aspects of the present invention are also achieved by providing a cooling system, including a compressor, a condenser, a pressure reducing unit, an evaporator's peripheral unit, an evaporator, and a flexible refrigerant pipe. The compressor compresses a refrigerant to increase pressure of the refrigerant. The condenser condenses the compressed refrigerant fed from the compressor. The pressure reducing unit reduces pressure of the condensed refrigerant fed from the condenser. The evaporator's peripheral unit includes an evaporator fan and an evaporator fan motor. The evaporator absorbs heat from surroundings by evaporation of the pressure-reduced refrigerant fed from the pressure reducing unit. The flexible refrigerant pipe connects the compressor to the evaporator.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
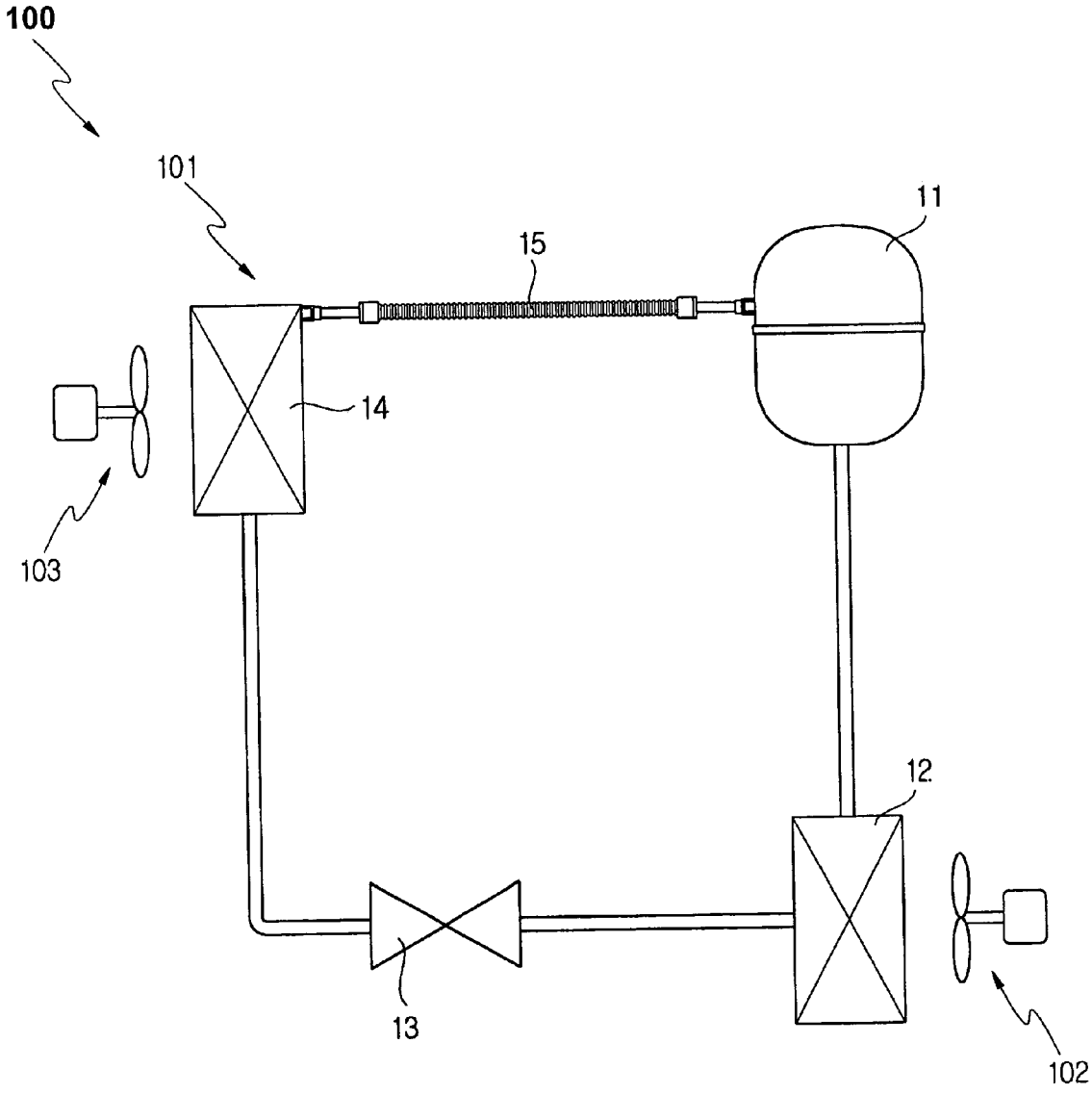
FIG. 1 is a schematic view of a cooling system, according to an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

According to an embodiment of the present invention, a bellows pipe, which is flexible and has a force of restoration, is used as a refrigerant pipe 15.

According to an embodiment of the present invention, a cooling system 100 includes a condenser-side motored fan 102 and an evaporator-side motored fan 103, in addition to a refrigerant circulation unit 101. The condenser-side motored fan 102 circulates air around a condenser 12 to perform a heat exchange process. The evaporator-side motored fan 103 circulates air around an evaporator 14 to perform a heat exchange process. Although not shown in FIG. 1 in detail, according to an embodiment of the present invention, when it is required to replace or repair the evaporator-side motored fan 103, it is necessary to move the evaporator 14 by a predetermined distance. Further, according to another embodiment of the present invention, the evaporator 14 and the evaporator-side motored fan 103 may be assembled into a cooling set of a single structure.

Figure 2:
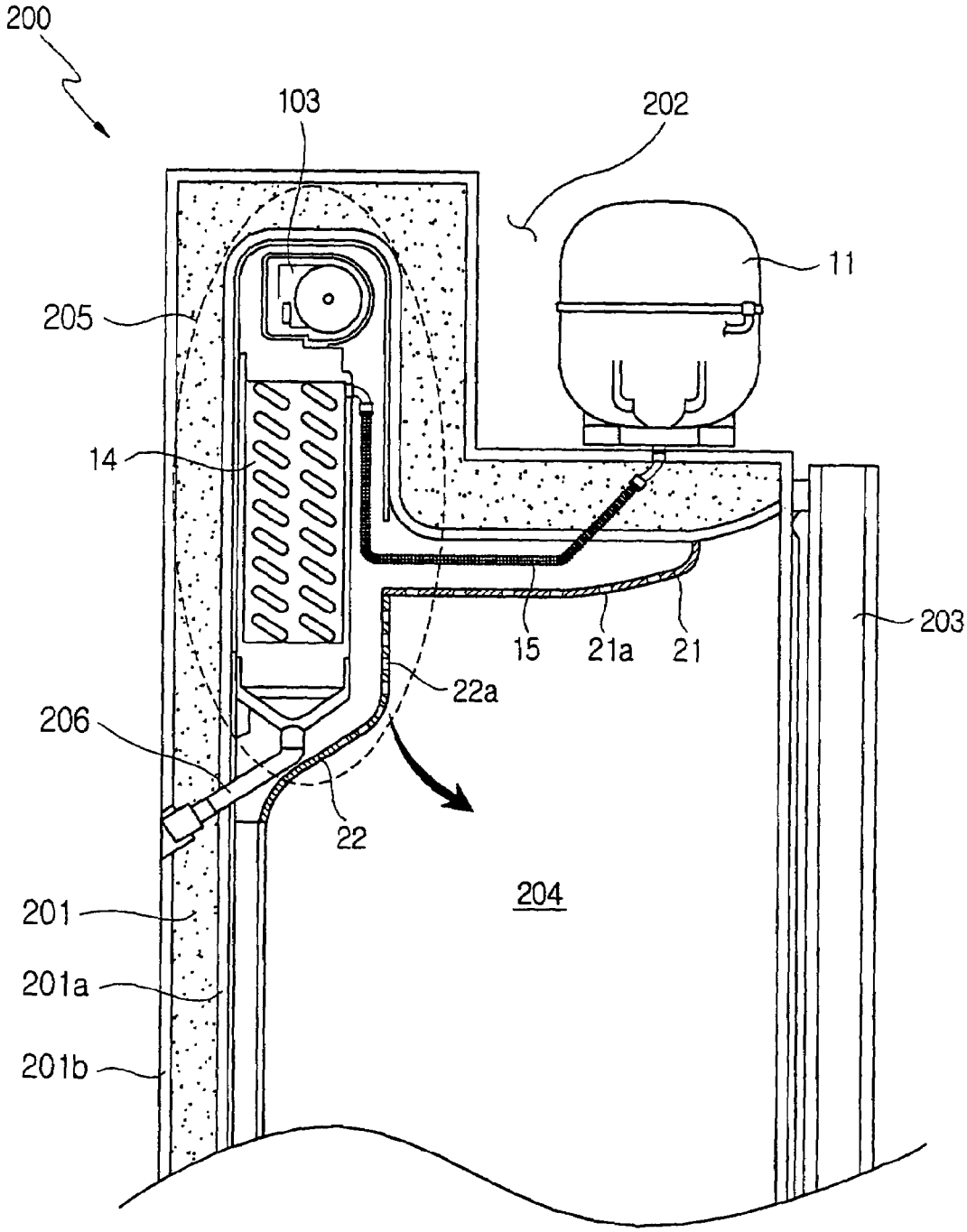
FIG. 2 is a sectional view illustrating a part of a refrigerator fabricated by the use of the cooling system, according to an embodiment of the present invention.

FIG. 2 is a sectional view of a refrigerator 200, which is fabricated by the use of the cooling system 100 of FIG. 1, according to an embodiment of the present invention.

Referring to FIG. 2, according to an embodiment of the present invention, the refrigerator 200 includes a cabinet 201 which has an inner casing 201*a* and an outer casing 201*b*. The inner casing 201*a* defines an inner surface of the refrigerator 200, and the outer casing 201*b* defines an outer surface of the refrigerator 200. Upper surfaces of the inner and outer casings 201*a* and 201*b* have the same stepped structure. A machine room 202 is provided in a space which is defined above a lower portion of the stepped structure of the outer casing 201*b* in such a way as to be positioned outside the cabinet 201. A cooling compartment 204 is defined by the inner casing 201*a* in such a way as to be positioned in the cabinet 201. A door 203 is mounted to a front of the refrigerator 200 to open or close the cooling compartment 204. A compressor 11 is installed at a predetermined position of the machine room 202. A cooling set 205 is provided in a space which is defined under an upper portion of the stepped structure of the inner casing 201*a* in such a way as to be positioned in the cooling compartment 204. The cooling set 205 includes the evaporator 14 and the evaporator-side motored fan 103. A refrigerant pipe 15 passes through the inner and outer casings 201*a* and 201*b* to connect the compressor 11 to the evaporator 14. The refrigerant pipe 15 has a bellows pipe structure which is flexible and has a force of restoration, so the refrigerant pipe 15 is not damaged even when it is bent. Further, the refrigerator 200 has a pipe cover 21 to cover the refrigerant pipe 15, thus providing a good appearance to the interior of the refrigerator 200. The pipe cover 21 is provided with a plurality of cool air circulation holes 21*a* to define a cool air path. As illustrated in FIG. 2, the stepped structure is designed such that its lower portion is defined at a front portion of the refrigerator 200, and its upper portion is defined at a rear portion of the refrigerator 200.

Further, as illustrated in FIG. 2, the evaporator-side motored fan 103 is provided above the evaporator 14. A cover 22 is provided to cover the bottom of the evaporator 14, thus providing a good appearance to the interior of the refrigerator 200. A plurality of cool air circulation holes 22*a* are formed on the cover 22. The evaporator 14, the evaporator-side motored fan 103, and the cover 22 may be assembled into the cooling set 205 of a single structure in order to enhance assembling efficiency of the refrigerator 200. According to an embodiment of the present invention, a cooling set which is constructed to have a single integrated structure is used. Additionally, the cooling set 205 may be provided with several sensors for electrically controlling the cooling set 205 and other devices.

When the evaporator-side motored fan 103, the sensors, or other devices which constitute the cooling set 205 must be replaced or repaired due to their malfunction, a user disassembles the pipe cover 21 and moves the cooling set 205 by a predetermined distance in a direction as shown by the bold arrow of FIG. 2. In this case, since the refrigerant pipe 15 connecting the compressor 11 to the evaporator 14 is flexible, it is possible to easily change the position of the cooling set 205 without the necessity of removing the evaporator 14 from the refrigerant circulation unit 101. Although not shown in FIGS. 1 and 2, a pipe connecting the pressure reducing unit 13 to the evaporator 14 may be thin and wound with a spring. Thus, although the pipe is bent or folded when the cooling set 205 is moved, the pipe is not damaged.

In FIG. 2, the reference numeral 206 denotes a drain pipe through which water is discharged from the evaporator 14.

Figure 3:
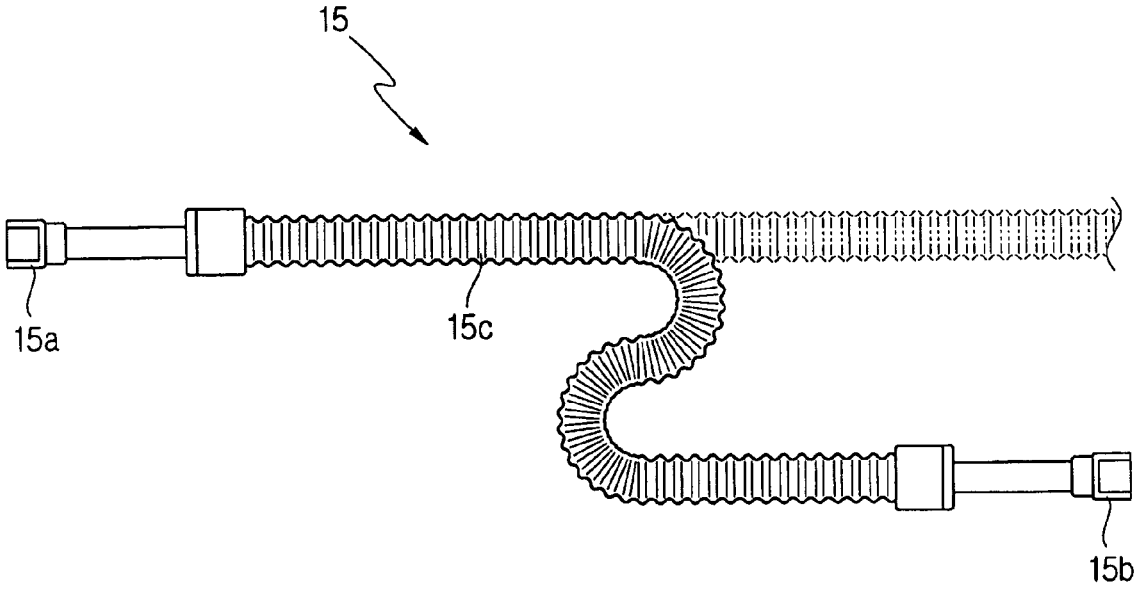
FIG. 3 is a perspective view of a refrigerant pipe which is applied to the cooling system and the refrigerator illustrated in FIGS. 1 and 2, respectively.

FIG. 3 illustrates the refrigerant pipe 15, which is a characteristic of the present invention. The refrigerant pipe 15 connecting the evaporator 14 to the compressor 11 has a flexible bellows pipe structure. As illustrated in FIG. 3, the refrigerant pipe 15 is provided at its opposite ends with connecting parts 15*a* and 15*b* which are connected to the evaporator 14 and the compressor 11, respectively. Further, the refrigerant pipe 15 is provided with a flexible part 15*c*, so it is possible to bend the refrigerant pipe 15, as shown by the solid line and the dotted line of FIG. 3, without damaging the refrigerant pipe 15.

As is apparent from the above description, the present invention allows a cooling set, including an evaporator, to be easily mounted to, and removed from, a cooling compartment, and prevents a refrigerant pipe from being damaged, thus enhancing work efficiency.

The present invention may be applied to a case where a cooling set does not have a single structure, such as where an evaporator is installed to be moved to allow a malfunctioning peripheral unit, including an evaporator-side motored fan, to be replaced or repaired without being limited to the embodiments illustrated in FIGS. 1 and 2. That is, the refrigerator shown in FIG. 2 is only an example where the evaporator is installed in such a way as to be able to be moved by a predetermined distance to repair or replace the evaporator's peripheral unit. Further, the present invention is not restricted to a case where the cooling set has a single structure, it could be used where only the evaporator must be moved to repair or replace an evaporator's peripheral unit. According to the present invention, the refrigerant pipe connecting the evaporator to the compressor is flexible and has a force of restoration, so the refrigerant pipe is not damaged when it is bent by an external force, thus accomplishing the aspects and effect of the present invention in the case where an external force is applied to the refrigerant pipe, such as when it is required to move the evaporator or the compressor. Therefore, a main feature of the present invention is to design the refrigerant pipe connecting the evaporator to the compressor such that it is flexible and has a force of restoration.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator, comprising:

a cabinet having an inner casing to define an inner surface of the refrigerator and an outer casing to define an outer surface of the refrigerator, wherein the cabinet, the inner casing, and the outer casing have an upper portion and a lower portion;

a machine room, which is provided in a space which is defined above the lower portion of the outer casing and which is positioned outside of the cabinet;

a cooling compartment defined by the inner casing and having an upper rear part;

a compressor disposed at a predetermined position of the machine room;

a cooling set which is installed at the upper rear part of the cooling compartment, wherein the cooling set has an evaporator; and a flexible refrigerant pipe connecting the compressor to the evaporator.

2. The refrigerator according to claim 1, the refrigerant pipe is able to resume a former shape.

3. The refrigerator according to claim 1, wherein the cooling set further comprises a fan and a fan motor.

4. The refrigerator according to claim 3, wherein the elements of the cooling set are assembled into a single structure.

5. The refrigerator according to claim 1, wherein upper surfaces of the inner and outer casings have a same stepped structure having the lower portion, and the machine room is provided in the space which is defined above the lower portion of the stepped structure of The outer casing.

6. The refrigerator according to claim 1, wherein upper surfaces of the inner and outer casings have a same stepped structure having the upper portion, and the cooling set is provided in a space which is defined under the upper portion of the stepped structure of the inner casing.

7. The refrigerator according to claim 6, wherein the cooling set further comprises an evaporator fan and an evaporator fan motor, the evaporator fan and fan motor being provided above the evaporator.

8. The refrigerator according to claim 7, wherein elements of the cooling set are assembled into a single structure.

9. The refrigerator according to claim 8, wherein the cooling set further comprises a plurality of sensors electrically controlling the cooling set and other devices.

10. The refrigerator according to claim 7, wherein the cooling set further comprises a cover to cover a bottom of the evaporator.

11. The refrigerator according to claim 10, wherein the cover further comprises a plurality of circulation apertures which circulate cool air.

12. The refrigerator according to claim 10, wherein elements of the cooling set are assembled into a single structure.

13. The refrigerator according to claim 6, wherein the stepped structure has the lower portion thereof defined at a front portion of the refrigerator, and the upper portion thereof defined at a rear portion of the refrigerator.

14. The refrigerator according to claim 1, wherein the cooling compartment further comprises a pipe cover to cover the refrigerant pipe.

15. The refrigerator according to claim 14, wherein the pipe cover further comprises a plurality of circulation apertures which circulate cool air.

16. The refrigerator according to claim 1, wherein the refrigerant pipe passes through the inner and outer casings to connect the compressor to the evaporator.

17. The refrigerator according to claim 1, wherein the refrigerant pipe has a bellows pipe structure.

18. The refrigerator according to claim 1, further comprising a pipe connecting the evaporator to other elements in a cooling system, wherein the pipe is flexible and able to return to a former shape.

19. The refrigerator according to claim 1, further comprising connecting parts provided at opposite ends of the refrigerant pipe, wherein the connecting parts are connected to the evaporator and the compressor, respectively.

20. A refrigerator, comprising:

cabinet having an upper portion and a lower portion:

a machine room, which is provided in a space which is defined above the lower portion and which is positioned outside of the cabinet a cooling compartment defined in the cabinet, wherein the cooling compartment has an upper rear part;

a compressor disposed at a predetermined position of the machine room;

an evaporator disposed in the upper rear part of the cooling compartment;

an evaporator's peripheral unit comprising an evaporator fan and an evaporator fan motor, wherein the evaporator's peripheral unit is disposed in the upper rear part; and a flexible refrigerant pipe connecting the compressor to the evaporator.

21. The refrigerator according to claim 20, wherein the refrigerant pipe is able to resume a former shape.

22. The refrigerator according to claim 20, wherein the evaporator is disposed so as to be movable by a predetermined distance, thus allowing the evaporator's peripheral unit to be replaced or repaired.

23. The refrigerator according to claim 20, wherein the evaporator and the evaporator's peripheral unit are assembled into a cooling set of a single structure.

24. The refrigerator according to claim 23, wherein the cooling set further comprises a plurality of sensors electrically controlling the cooling set and other devices.

25. The refrigerator according to claim 23, wherein the cooling set further comprises a cover to cover an outer surface of the cooling set.

26. The refrigerator according to claim 25, wherein the cover further comprises a plurality of circulation apertures which circulate air.

27. The refrigerator according to claim 20, wherein the refrigerant pipe has a bellows pipe structure.

28. The refrigerator according to claim 20, further comprising a pipe connecting the evaporator to other elements in a cooling system, wherein the pipe is flexible and able to return to a former shape.

29. A cooling system, comprising:

a cabinet having an upper portion and a lower portion;

a compressor to compress a refrigerant, thus increasing pressure of the refrigerant, wherein the compressor is disposed on the lower portion of the cabinet and outside of the cabinet;

a condenser to condense the compressed refrigerant;

a pressure reducing unit to reduce pressure of the condensed refrigerant;

an evaporators peripheral unit comprising an evaporator fan and an evaporator tan motor;

an evaporator to absorb heat from surroundings by evaporation of the pressure-reduced refrigerant; and a flexible refrigerant pipe to connect the compressor to the evaporator.

30. The cooling system according to claim 29, wherein the refrigerant pipe is able to resume a former shape.

31. The cooling system according to claim 29, wherein the evaporator is disposed in such a way as to be movable by a predetermined distance, thus allowing the evaporator's peripheral unit to be replaced or repaired.

32. The cooling system according to claim 29, wherein the evaporator and the evaporator's peripheral unit are assembled into a cooling set of a single structure.

33. The cooling system according to claim 32, wherein the cooling set further comprises a plurality of sensors electrically controlling the cooling set and other devices.

34. The cooling system according to claim 32, wherein the cooling set further comprises a cover to cover an outer surface of the cooling set.

35. The cooling system according to claim 34, wherein the cover further comprises a plurality of circulation apertures which circulate air.

36. The refrigerator according to claim 29, wherein the refrigerant pipe has a bellows pipe structure.

37. The cooling system according to claim 29, further comprising a pipe connecting the evaporator to other elements in the cooling system, wherein the pipe is flexible and able to return to a former shape.

* * * * *

UNITED STATES PATENT AND TRADEMARK OFFICE

CERTIFICATE OF CORRECTION

PATENT NO. : 7,003,973 B2
APPLICATION NO. : 10/673184
DATED : February 28, 2006
INVENTOR(S) : Jong Dal Lee et al.

It is certified that error appears in the above-identified patent and that said Letters Patent is hereby corrected as shown below:

TITLE Page, ITEM (75) (Inventors), Line 2, delete "Kwangjiu" and insert --Kwangju-- therefor.
Col. 5, Line 64, after "claim 1" insert --wherein--.
Col. 6, Line 8, delete "The" and insert --the-- therefor.
Col. 6, Line 58, insert --a-- before "cabinet".
Col. 6, Line 58, after "lower portion" delete ":" and insert --;-- therefor.
Col. 6, Line 61, after "cabinet" insert --;--.
Col. 8, Line 4, delete "evaporators" and insert --evaporator's-- therefor.
Col. 8, Line 5, delete "tan" and insert --fan-- therefor.
Col. 8, Line 29, delete "refrigerator" and insert --cooling system-- therefor.

Signed and Sealed this

Nineteenth Day of September, 2006

JON W. DUDAS
*Director of the United States Patent and Trademark Office*